US009837695B2

(12) United States Patent
Gregoire et al.

(10) Patent No.: US 9,837,695 B2
(45) Date of Patent: Dec. 5, 2017

(54) SURFACE-WAVE WAVEGUIDE WITH CONDUCTIVE SIDEWALLS AND APPLICATION IN ANTENNAS

(71) Applicant: The Boeing Company, Chicago, IL (US)

(72) Inventors: Daniel J. Gregoire, Thousand Oaks, CA (US); Amit M. Patel, Santa Monica, CA (US)

(73) Assignee: The Boeing Company, Chicago, IL (US)

( * ) Notice: Subject to any disclaimer, the term of this patent is extended or adjusted under 35 U.S.C. 154(b) by 646 days.

(21) Appl. No.: 14/449,853

(22) Filed: Aug. 1, 2014

(65) Prior Publication Data

US 2016/0036111 A1 Feb. 4, 2016

(51) Int. Cl.

| | |
|---|---|
| ***H01Q 13/00*** | (2006.01) |
| ***H01P 3/02*** | (2006.01) |
| ***H01Q 15/00*** | (2006.01) |
| ***H01Q 3/44*** | (2006.01) |
| ***H01Q 13/26*** | (2006.01) |
| ***H01Q 13/28*** | (2006.01) |
| ***H01Q 21/06*** | (2006.01) |
| ***H01P 5/08*** | (2006.01) |
| ***H01Q 3/34*** | (2006.01) |
| *H01P 5/103* | (2006.01) |
| *H01Q 3/36* | (2006.01) |

(52) U.S. Cl.

CPC ..... *H01P 3/02* (2013.01); *H01P 5/08* (2013.01); *H01Q 3/34* (2013.01); *H01Q 3/443* (2013.01); *H01Q 13/00* (2013.01); *H01Q 13/26* (2013.01); *H01Q 13/28* (2013.01); *H01Q 15/0066* (2013.01); *H01Q 21/068* (2013.01); *H01P 5/103* (2013.01); *H01Q 3/36* (2013.01)

(58) Field of Classification Search

CPC ..... H01Q 13/00; H01Q 3/34
USPC ..... 343/777
See application file for complete search history.

(56) References Cited

U.S. PATENT DOCUMENTS

| | | | |
|---|---|---|---|
| 2,840,818 | A | 6/1958 | Reed et al. |
| 2,914,766 | A | 11/1959 | Butler |
| 3,225,351 | A | 12/1965 | Chatelain et al. |

(Continued)

OTHER PUBLICATIONS

Hyneman R.F., et al.; "Waveguide Loaded Surface Wave Antenna," IRE International Convention Record, 1958, pp. 225-229, vol. 6, XP055231025.

(Continued)

*Primary Examiner* — Huedung Mancuso
(74) *Attorney, Agent, or Firm* — Charles L. Moore; Moore & Van Allen PLLC

(57) ABSTRACT

A surface-wave waveguide may include a base conductive ground plane including opposite side edges and a pair of conductive side walls. One conductive side wall extends from each side edge of the conductive ground plane. The surface-wave waveguide may also include a substrate including a dielectric material disposed on the base conductive ground plane and between the conductive side walls. The surface-wave waveguide may also include an impedance sheet disposed on the substrate and between the conductive side walls. The impedance sheet may include a predetermined impedance characteristic for transmitting an electromagnetic wave.

20 Claims, 8 Drawing Sheets

(56) References Cited

U.S. PATENT DOCUMENTS

| | | | | |
|---|---|---|---|---|
| 4,682,180 | A * | 7/1987 | Gans | H01Q 13/18 343/769 |
| 6,806,846 | B1 | 10/2004 | West | |
| 7,012,572 | B1 * | 3/2006 | Schaffner | H01Q 3/24 343/725 |
| 8,648,768 | B2 * | 2/2014 | Mussler | H01Q 1/28 343/753 |
| 9,154,966 | B2 * | 10/2015 | Bennett | H04B 7/022 |
| 9,312,919 | B1 * | 4/2016 | Barzegar | H04B 3/546 |
| 2007/0069966 | A1 | 3/2007 | Rolnik | |
| 2013/0266319 | A1 | 10/2013 | Bodan et al. | |

OTHER PUBLICATIONS

Gregoire, D.J. et al.; "An Electronically-Steerable Artificial-Impedance-Surface Antenna," IEEE, 2014, pp. 551-552, XP032645980.
Canadian Patent Office; Office Action for Canadian Patent Application No. 2,892,643 dated Jun. 7, 2016, 3 Pages.
European Patent Office; Extended European Search Report for European Patent Application No. 15179130.8 dated Dec. 15, 2015, 15 Pages.
European Patent Office; Office Action for European Patent Application No. 15179130.8 dated Sep. 22, 2016, 7 Pages.
Collin, R., "Field theory of guided waves, 2nd Ed.," IEEE Press, 1996, pp. 705-708.
Fong et al., "Scalar and Tensor Holographic Artificial Impedance Surfaces," IEEE Trans. Antennas Prop., vol. 58, 2010, pp. 3212-2331.
Gregoire et al., "Artificial Impedance Surface Antennas." HRL Laboratories LLC, 2011, Distribution A, pp. 1-13.
Gregoire et al., "Surface-Wave Waveguides," IEEE Antennas and Wireless Propagation Letters, vol. 10, 2011, pp. 1512-1515.
Gregoire et al., "Artificial Impedance Surface Antennas, Design and Simulation," HRL Laboratories LLC, 2010, pp. 1-14.
Luukkonen et al., "Simple and Accurate Analytical Model of Planar Grids and High-Impedance Surfaces Comprising Metal Strips or Patches," IEEE Transactions on Antennas and Propagation vol. 56. No. 6, Jun. 2008, pp. 1624-1632.
Patel et al., "A Printed Leaky-Wave Antenna Based on a Sinusoidally-Modulated Reactance Surface," IEE Transactions on Antennas and Propagation, vol. 59, No. 6, Jun. 2011, pp. 2087-2096.
Sievenpiper et al., "High-Impedance Electromagnetic Surfaces with a Forbidden Frequency Band," IEEE Transactions on Microwave Theory and Techniquies, vol. 47, No. 11, Nov. 1999, pp. 2059-2074.
Quarforth et al., "Impedance Surface Waveguide Theory and Simulation," APSURSI, 2011 IEEE International Symposium, Jul. 3-8, 2010, pp. 1159-1162.
Patel et al., "A Printed Leaky-Wave Antenna with a Sinusoidally Modulated Surface Reactance," IEEE Antennas and Propagation Society International Symposium, 2009, pages 1-4.
The Boeing Company, U.S. Appl. No. 13/934,553, filed Jul. 3, 2013, pp. 1-51 and 15 sheets of drawings.
Canadian Patent Office; Office Action for Canadian Patent Application No. 2,892,643 dated Apr. 21, 2017, 4 Pages.
European Patent Office; Office Action for European Patent Application No. 15179130.8 dated May 19, 2017, 6 Pages.

* cited by examiner

SURFACE-WAVE WAVEGUIDE WITH CONDUCTIVE SIDEWALLS AND APPLICATION IN ANTENNAS

FIELD

The present disclosure relates to waveguides and antennas, and more particularly to a surface-wave waveguide with conductive sidewalls and application of the waveguide in antennas or antenna systems.

BACKGROUND

A surface-wave (SW) media is any structure that supports a surface wave. SW mediums are a subset of a broader class of meta-materials known as artificial-impedance-surfaces or high-impedance surfaces. An SW medium may support surface waves that are polarized in either transverse electric (TE) or transverse magnetic (TM) modes. The SW index ($n_{SW}$) or the SW impedance ($Z_{TE}$ and $Z_{TM}$) characterizes the SW media properties. The simplest form of an SW media is a grounded dielectric sheet. At frequencies less than about 10 or 20 Gigahertz (GHz), the grounded dielectric is not practical because it must be very thick or use a substrate with excessively high permittivity to efficiently support surface waves. An SW waveguide is an SW medium that may be formed by a strip of material including a constant SW index surrounded by an SW medium with a lower index. This structure is effectively a two-dimensional equivalent of a three-dimensional dielectric waveguide. From an optics viewpoint, the SW waveguide may be thought of as a high-index two-dimensional fiber optic transmission line surrounded by a lower index medium. The high-index and low-index regions of an SW waveguide may be realized with high and low-permittivity materials. In the case of an SW waveguide, the high-index and low-index region can be realized with metallic patches varying in size and/or shape on a dielectric substrate. SW waveguides can be used for transmitting SW power in applications, such as two-dimensional wireless power transmission for feeding structures like artificial-impedance-surface antennas (AISAs) and for controlling SW scattering. However, current SW waveguides can leak power out the sides and the AISA array elements have to be spaced more than about $1/\lambda$ (wavelength of the radiating element or antenna) apart in order to prevent grading side lobes in the radiation pattern. The wide spacing also reduces the scan angle in a direction perpendicular to a plane of the SW waveguide or measured from a plane of the waveguide.

SUMMARY

In accordance with an embodiment, a surface-wave (SW) waveguide may include a base conductive ground plane including opposite side edges and a pair of conductive side walls. One conductive side wall extends from each side edge of the conductive ground plane. The SW waveguide may also include a substrate including a dielectric material disposed on the base conductive ground plane and between the conductive side walls. The SW waveguide may additionally include an impedance sheet disposed on the substrate and between the conductive side walls. The impedance sheet may include a predetermined impedance characteristic for transmitting an electromagnetic wave.

In accordance with another embodiment, an antenna system may include a plurality of radiating elements configured to transmit and receive electromagnetic energy. Each of the radiating elements may include an SW waveguide. The SW waveguide may include a base conductive ground plane including opposite side edges and a pair of conductive side walls. One conductive side wall extends from each side edge of the base conductive ground plane. The SW waveguide may also include a substrate including a dielectric material disposed on the base conductive ground plane and between the conductive side walls. The SW waveguide may additionally include an impedance sheet disposed on the substrate and between the conductive side walls. The impedance sheet comprises a predetermined impedance characteristic for transmitting an electromagnetic wave.

In accordance with a further embodiment, a method for electronically steering an antenna system may include transmitting an electromagnetic wave along an SW waveguide. The SW waveguide may include a base conductive ground plane including opposite side edges and a pair of conductive side walls. One conductive side wall extends from each side edge of the conductive ground plane. The SW waveguide may also include a substrate comprising a dielectric material disposed on the base conductive ground plane and between the conductive side walls. The SW waveguide may additionally include an impedance sheet disposed on the substrate and between the conductive side walls. The impedance sheet may include a predetermined impedance characteristic for transmitting an electromagnetic wave and the impedance sheet may include a tunable element. The method may also include tuning the tunable element to scan a main radiation lobe of a radiation pattern generated by the antenna system over a range of angles in a direction perpendicular to a plane of the antenna system.

BRIEF DESCRIPTION OF THE SEVERAL VIEWS OF DRAWINGS

The following detailed description of embodiments refers to the accompanying drawings, which illustrate specific embodiments of the disclosure. Other embodiments having different structures and operations do not depart from the scope of the present disclosure.

DETAILED DESCRIPTION

Figure 1A:
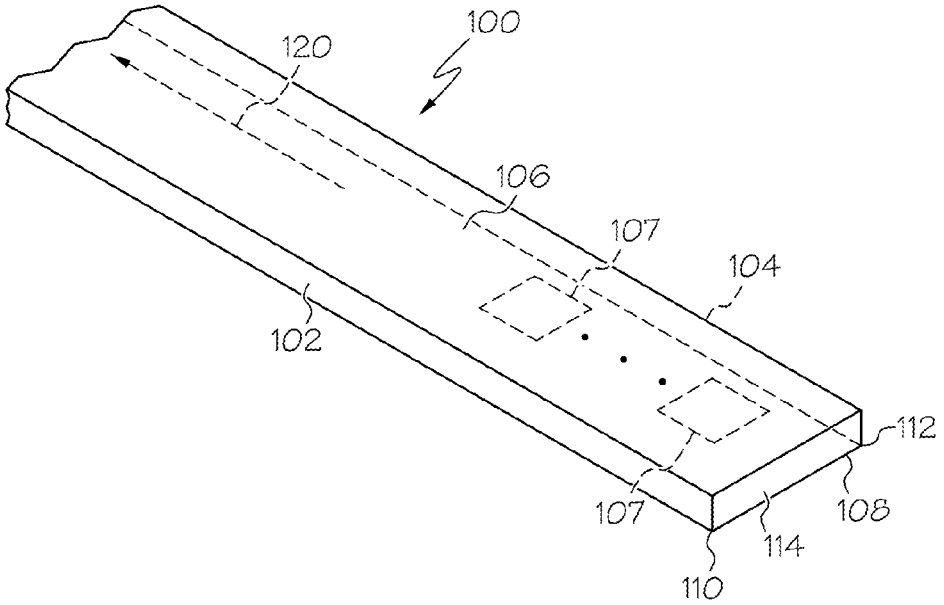
FIG. 1A is a perspective view of an example of an SW waveguide including conductive side walls in accordance with an embodiment of the present disclosure.

The following detailed description of embodiments refers to the accompanying drawings, which illustrate specific embodiments of the disclosure. Other embodiments having different structures and operations do not depart from the scope of the present disclosure. Like reference numerals may refer to the same element or component in the different drawings.

In accordance with an exemplary embodiment, an SW waveguide includes side walls that confine a surface-wave propagating along the waveguide to remain within a well-defined channel. The side walls of the SW waveguide do not allow surface-wave power to leak out the sides of the waveguide. The side walls also permit the SW waveguide to be made narrower than previous SW waveguides without side walls. Narrower waveguides are advantageous for use with SW waveguide artificial-impedance-surface antenna (AISA) arrays where the AISA array elements have to be spaced closer than ½λ apart in order to prevent grating side lobes in the radiation pattern of the antenna. Where λ is the wavelength of the radiating elements of the AISA array. A narrow SW waveguide in an AISA array that prevents grating side lobes allows the antenna to be scanned to much higher scan angles because the radiation pattern from a narrower SW AISA extends farther to each side of the antenna.

The exemplary embodiments described herein enable the design of antennas, for example satellite communications antennas (SATCOM) and other antennas, that are electronically-steerable AISAs. The AISAs do not have side lobes and include a higher scan angle than other AISAs that cannot be spaced closer than ½λ. The exemplary SW waveguide AISA embodiments described herein may be made with a width less than about ½λ or narrower. The ½λ spacing or less between the antenna array elements eliminates side grating lobes. As the width gets smaller, the SW waveguide radiation pattern broadens out in the direction of its width. This facilitates scanning to high angles relative to the SW waveguide axis or plane defined the radiating surface of the SW waveguide.

Figure 1B:
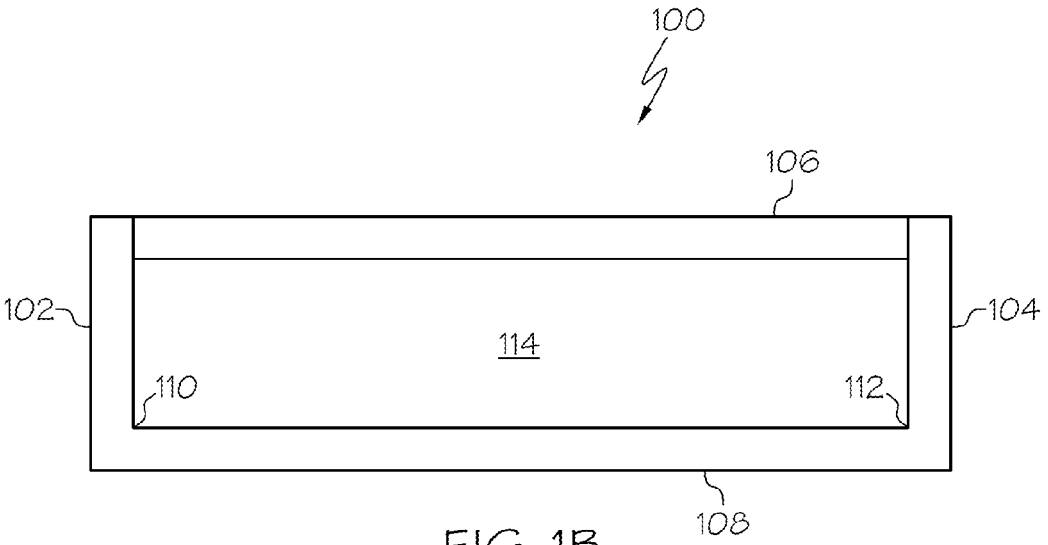
FIG. 1B is an end view of the exemplary SW waveguide of FIG. 1A.
Figure 1C:
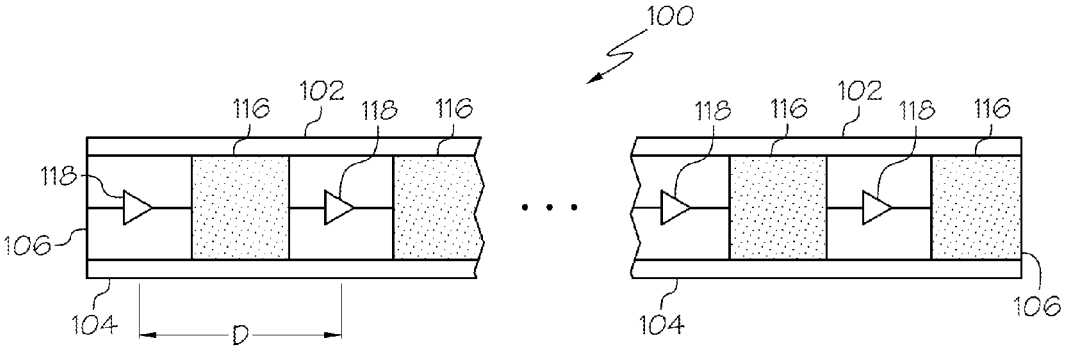
FIG. 1C is a top view of the exemplary SW waveguide of FIG. 1A including an impedance sheet that can be modulated or tuned in accordance with an embodiment of the present disclosure.

FIG. 1A is a perspective view of an example of an SW waveguide 100 including conductive side walls 102 and 104 (as best shown in FIG. 1B and FIG. 1C) in accordance with an embodiment of the present disclosure. FIG. 1B is an end view of the exemplary SW waveguide 100 of FIG. 1A and FIG. 1C is top view of the exemplary SW waveguide 100 of FIG. 1A including an example of an impedance sheet 106 that can be modulated or tuned in accordance with another embodiment of the present disclosure.

The SW waveguide 100 may include a base conductive ground plane 108 as best shown in FIG. 1B. The base conductive ground plane 108 may include opposite side edges 110 and 112. The base conductive ground plane 108 may be any conductive material capable of conducting electrical or magnetic energy. The conductive ground plane 108 may also be a semiconductor material in another exemplary embodiment. The pair of conductive side walls 102 and 104 may respectively extend from each side edge 110 and 112 of the conductive ground plane 108. The conductive side walls 102 and 104 may be any conductive material capable of conducting electrical and magnetic energy. The conductive side walls 102 and 104 may also be a semiconductor material in another exemplary embodiment.

A substrate 114 may be disposed on the base conductive ground plane 108 and between the conductive side walls 102 and 104. The substrate 114 may be a dielectric material. The substrate material can be any plastic, glass or electronic substrate such as those used by printed circuit board fabricators. In another embodiment, the substrate 114 may include or may be replaced by an air core. The air core replacing the substrate 114 will reduce SW propagation loss that may be caused by radio frequency (RF) losses in the substrate 114.

An impedance sheet 106 may be disposed on the substrate 114 and between the conductive side walls 102 and 104. The impedance sheet 106 may include a predetermined impedance characteristic for transmitting an electromagnetic wave. One method of producing an impedance sheet is to print conductive patches and/or form other components, such as for example, variable reactive components as described herein on top of the substrate 114. In an embodiment, the predetermined impedance characteristic of the impedance sheet 106 may have constant impedance across a surface of the substrate 114 or length and width of the impedance sheet 106. In another embodiment, the predetermined impedance characteristic of the impedance sheet 106 may vary across the sheet 106, such as along at least a length or longest dimension of the impedance sheet 106.

As described in more detail herein, the impedance sheet 106 may be formed with different elements or impedance elements 107, such as radiating elements and tunable elements that permit the impedance sheet 106 to be modulated. In an AISA, the impedance or elements 107 of the impedance sheet 106 may be periodically modulated to produce radiation from a surface electromagnetic wave propagating along the SW waveguide 100. The impedance elements 107 of the impedance sheet 106 may be fixed or may be tunable through application of a voltage to variable reactive elements built into the impedance sheet 106. Examples of such impedance sheets are described in U.S. patent application Ser. No. 13/934,553, filed Jul. 3, 2014 and which is assigned to the same assignee as the present application and is incorporated herein by reference.

In another embodiment, the impedance sheet 106 may include an array of metallic patches 116 similar to that shown in FIG. 1C or similar to the embodiment described with reference to FIG. 4A herein. In the exemplary embodiment illustrated in FIG. 1C, the impedance sheet 106 may include a plurality of metallic patches 116 disposed adjacent one another at a predetermined distance "D". A tunable impedance element 118 or variable reactive element may be electrically connected between adjacent metal patches 116. Examples of the tunable impedance element 118 or variable reactive element may include, but is not necessarily limited to a varactor, a liquid crystal element, a tunable material element comprising barium strontium nitrate or other tunable impedance element capable of modulating or tuning the impedance sheet 106 to provide the performance characteristics described herein, such as for example steering a main lobe or beam of a radiation pattern of an AISA. As described in more detail herein the tunable impedance element 118 may be configured to be tuned by a voltage being connected to at least one of the adjacent metallic patches 116 or by electric field or magnetic field being coupled to the tunable impedance element 118. The metallic patches 116 may be uniform and may have the same length and width dimensions and may be uniformly spaced from one another. In another embodiment, the metallic patches 116 may be different sizes and may have different shapes depending on what performance characteristics may be desired. The metallic patches 116 or radiating elements may also be at a varying spacing form one another. For example, the spacing between the metallic patches 116 may alternate between a long and short spacing.

Figure 2:
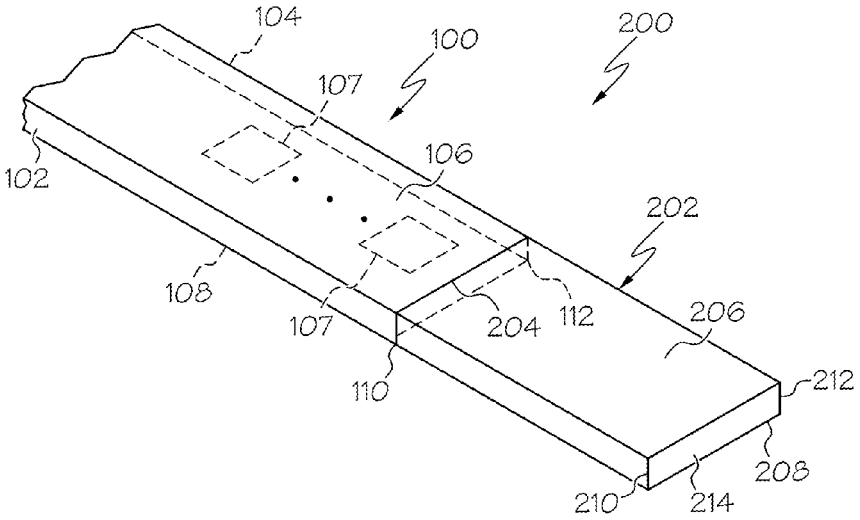
FIG. 2 is a perspective view of an example of an SW waveguide assembly including a waveguide feed section in accordance with an embodiment of the present disclosure.
Figure 3A:
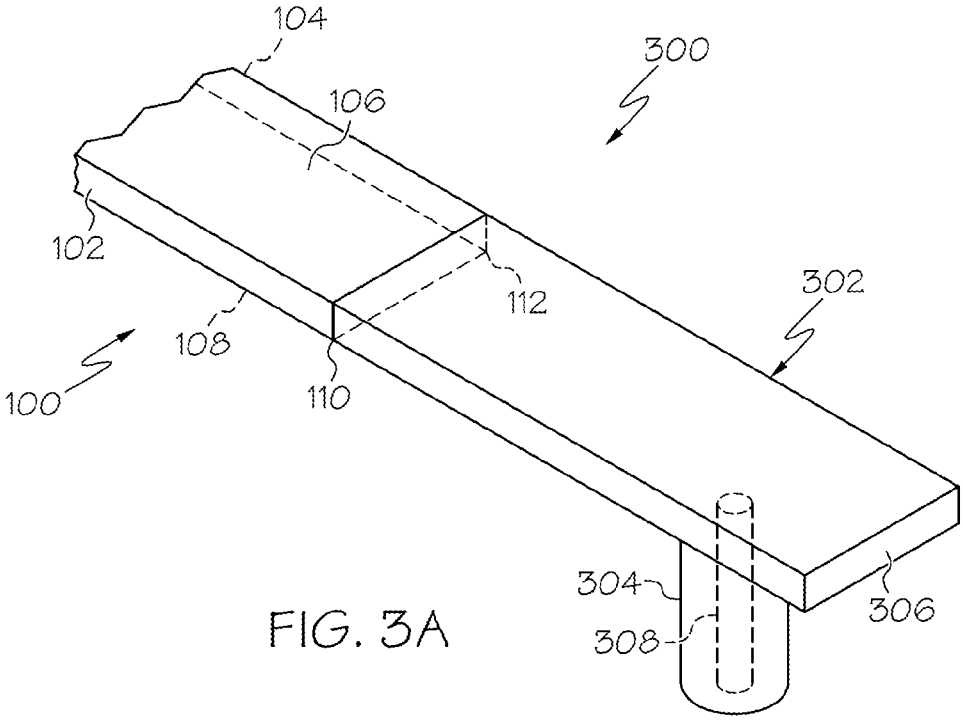
FIG. 3A is a perspective view of an example of a waveguide assembly including a waveguide feed section and a coaxial feed connector integrated into the waveguide feed section in accordance with an embodiment of the present disclosure.
Figure 3B:
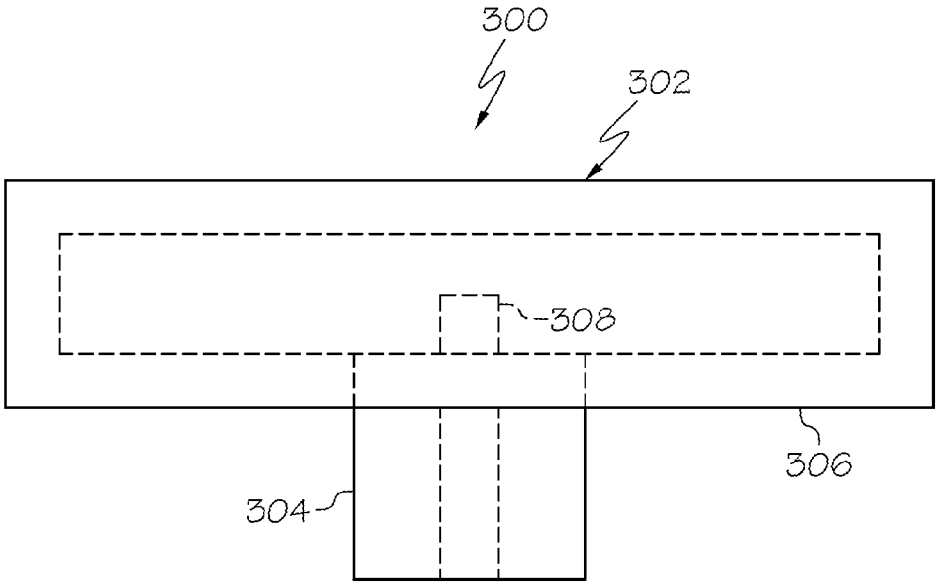
FIG. 3B is an end view of the exemplary SW waveguide of FIG. 3A.

The SW waveguide 100 including side walls 102 and 104 guides a surface wave 120 along a confined path or SW channel defined by the impedance sheet 106 between the side walls 102 and 104. As previously described, the side walls 102 and 104 prevent RF power from leaking from the impedance sheet 106 or channel. The surface wave 120 may be excited and coupled to external RF transmission lines by one of various exemplary arrangements. Referring also to FIG. 2 and FIGS. 3A and 3B, these figures illustrate examples of mechanisms for coupling to and exciting a surface wave on an SW waveguide similar to waveguide 100. FIG. 2 is a perspective view of an example of an SW waveguide assembly 200 including a waveguide feed section 202 in accordance with an embodiment of the present disclosure. The SW waveguide assembly 200 in FIG. 2 may include a waveguide similar to the SW waveguide 100 in FIGS. 1A-1C. In the exemplary embodiment in FIG. 2, the SW waveguide 100 may be terminated by a waveguide feed section 202. The waveguide feed section 202 may be a rectangular waveguide section 202 as illustrated in FIG. 2. The waveguide feed section 202 includes a first end 204 that has a shape and size that corresponds to a shape and size of an end of the SW waveguide 100 to matingly contact the end of the SW waveguide 100. The waveguide feed section 202 may be formed by top and bottom conductive walls 206 and 208 and side conductive walls 210 and 212. The top conductive wall 206 of the waveguide feed section 202 may correspond to and contact or join the impedance sheet 106. The bottom conductive wall 208 may correspond to and may contact or join the base conductive ground plane 108. The side conductive wall 210 may correspond to and may contact or join the conductive side wall 102 of the waveguide 100 and the side conductive wall 212 of the waveguide feed section 202 may correspond to and may contact or join the conductive side wall 112 of the SW waveguide 100. A waveguide aperture 214 is at an opposite end or second end of the waveguide feed section 202 from the first end 204 of the waveguide feed section 202 that interfaces with or joins the SW waveguide 100. The first end 204 defines a feed of the waveguide feed section 202 where an electromagnetic wave is transmitted from the waveguide feed section 202 to the SW waveguide 100. The waveguide feed section 202 may be connected to standard waveguide feed components in any of a number of arrangement. For example, the width and height of the waveguide feed section 202 may be tapered from the SW waveguide 100 dimensions to the dimensions of a standard waveguide section.

FIG. 3A is a perspective view of an example of an SW waveguide assembly 300 including a waveguide feed section 302 and a coaxial connector 304 integrated into the waveguide feed section 302 in accordance with an embodiment of the present disclosure. FIG. 3B is an end view of the exemplary SW waveguide assembly 300 of FIG. 3A. The SW waveguide assembly 300 in FIG. 3A may include a waveguide similar to the SW waveguide 100 in FIGS. 1A-1C. In the exemplary embodiment in FIG. 3A, the SW waveguide 100 may be terminated by a waveguide feed section 302. The waveguide feed section 302 may be similar to the waveguide feed section 202 in FIG. 2. However, the waveguide feed section 302 is terminated by a conductive end cap 306 rather than an aperture 214. A coaxial feed connector 304 is integrated into the waveguide feed section 302. A center conductor 308 in the coaxial connector 304 is used to excite surface waves in the SW waveguide 100 in response to an electromagnetic signal being transmitted by a coaxial transmission line (not shown in FIGS. 3A and 3B) connected to the coaxial connector 304, or a surface wave signal may be extracted by the center conductor 308 in response to an electromagnetic signal being received by elements 107 of the SW waveguide 100 as described herein. While the coaxial connector 304 is shown in the exemplary embodiment in FIGS. 3A and 3B as entering a bottom conductive wall of the waveguide feed section 302, the coaxial connector 304 may also enter the waveguide feed section 302 through any of the other walls or through the end cap 306.

Figure 4A:
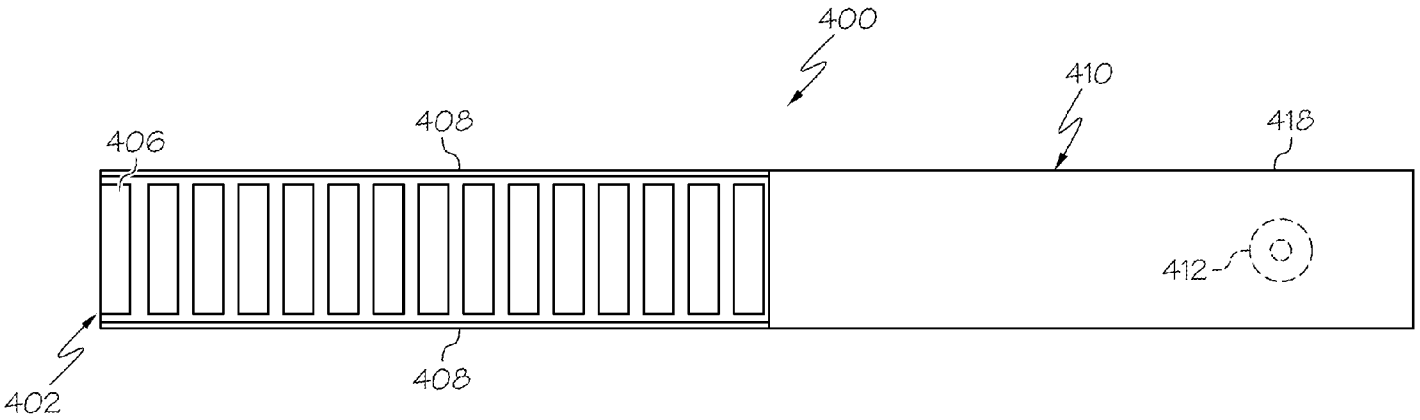
FIG. 4A is a top view of an example of an SW waveguide including a modulated impedance sheet and vias formed in the conductive side walls in accordance with an embodiment of the present disclosure.
Figure 4B:
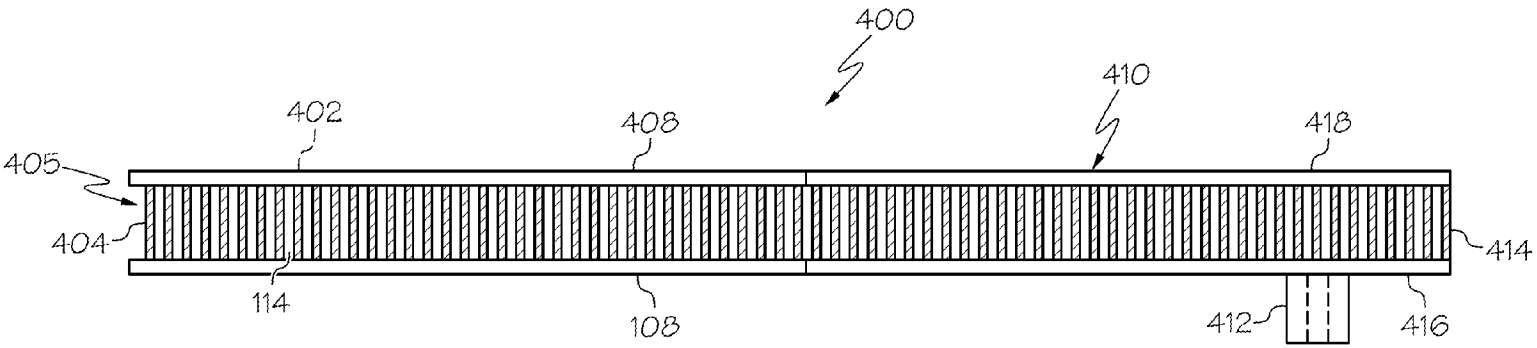
FIG. 4B is a side view of the exemplary SW waveguide of FIG. 4A.

FIG. 4A is a top view of an example of an SW waveguide 400 including a modulated impedance sheet 402 and vias 404 (as best shown in FIG. 4B) formed in the conductive side walls 405 in accordance with an embodiment of the present disclosure. Other exemplary embodiments may have only the modulated impedance sheet 402 or only the vias 404. FIG. 4B is a side view of the exemplary SW waveguide 400 of FIG. 4A. The SW waveguide 400 may be similar to the SW waveguide 100 of FIG. 1 except the impedance sheet 106 in FIG. 1 may be realized by the impedance sheet 402 that includes an array of conductive patches 406 on top of the substrate 114. The conductive side walls 102 and 104 in FIG. 1 may be replaced by conductive vias 404 that are electrically connected through the dielectric substrate 114 from the base conductive ground plane 108 to a metallic strip 408 that may connect an opposite end or top of the vias 404 to each other on each side of the SW waveguide 400 as shown in FIG. 4A. The SW waveguide 400 including the vias 404 may define a substrate integrated waveguide (SIW) with a top conductor replaced by a patterned metal representing the impedance sheet 402. The exemplary embodiment in FIGS. 4A and 4B may also be terminated by a waveguide feed section 410 including an integrated coaxial connector 412 that may be similar to the waveguide feed section 302 with integrated coaxial connector 304. The waveguide assembly 400 could also be terminated by a waveguide feed section 410 similar to waveguide feed section 202 in FIG. 2 or by some other mechanism for propagating a surface wave in the waveguide assembly 400. The waveguide feed section 410 may also include conductive vias 414 (best shown in FIG. 4B) that electrically connect between a bottom wall 416 and an upper wall 418 of the waveguide feed section 410.

The SW impedance ($Z_{SW}$) and the corresponding SW index ($n_{SW}$) for the exemplary SW waveguides described herein may be determined by the geometric dimensions of the SW waveguides, the impedance of the impedance sheet ($Z_{sheet}$), and the dielectric properties by solving the walled-SW waveguide transverse-resonance method (TRM) equation (equation 1) for $n_{SW}$:

$$k_0\left[\frac{1}{Z_0 k_{z0}} - j\frac{n_{sub}}{Z_{sub}k_{z,sub}}\cot(k_{z,sub}d)\right] + \frac{1}{Z_{sheet}} = 0 \quad \text{(Equation 1)}$$

$$\text{where } k_{z0} = \sqrt{k_0^2(1-n_{sw}^2) - \left(\frac{\pi}{w}\right)^2} \text{ and}$$

$$k_{z,sub} = \sqrt{k_0^2(n_{sub}^2 - n_{sw}^2) - \left(\frac{\pi}{w}\right)^2}$$

Where $k_0$ is the wavenumber of free-space radiation with the same frequency as the surface wave. $Z_0$, $Z_{sub}$ and $Z_{sheet}$ are the impedance of free space, the dielectric substrate and the impedance sheet respectively. $n_{sub}$ and d are the refractive index and thickness of the dielectric substrate, respectively. w is the width of the SW waveguide. When the impedance sheet is realized as an array of conductive patches, $Z_{sheet}$ is determined from the patch geometry and the substrate properties.

Figure 5A:
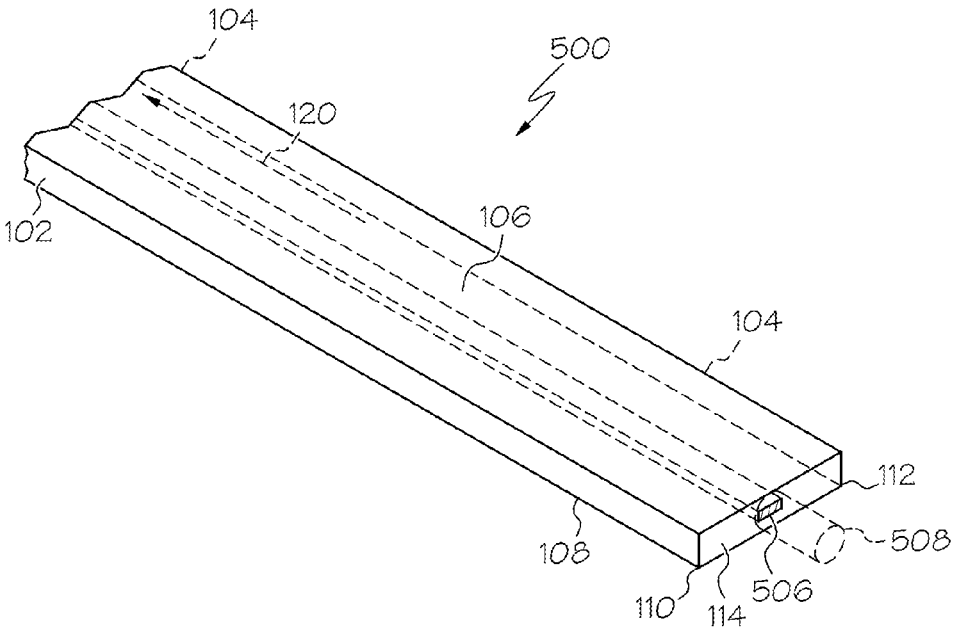
FIG. 5A is a perspective view of an example of an SW waveguide including conductive side walls and a center conductor in accordance with an embodiment of the present disclosure.
Figure 5B:
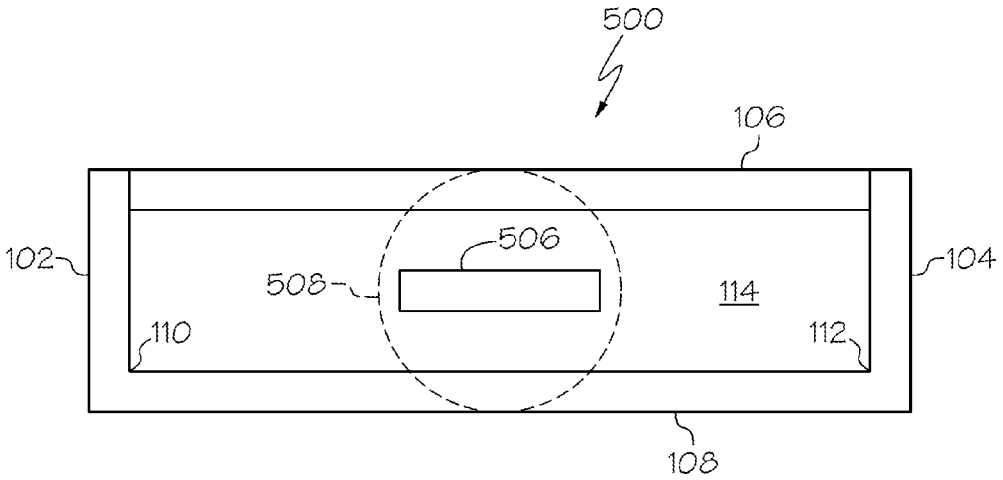
FIG. 5B is an end view of the exemplary SW waveguide of FIG. 5A.

FIG. 5A is a perspective view of an example of an SW waveguide 500 including conductive side walls 102 and 104 and a center conductor 506 in accordance with an embodiment of the present disclosure. FIG. 5B is an end view of the exemplary SW waveguide 500 of FIG. 5A. The SW waveguide 500 may be similar to the SW waveguide 100 in FIGS. 1A and 1B except including the center conductor 506 embedded within the dielectric substrate 114. The center conductor 506 may extend substantially the entire length of the SW waveguide 500 or only partially the length of the waveguide 500. The center conductor 506 may have a substantially rectangular cross-section as shown in the exemplary embodiment in FIGS. 5A and 5B. In other embodiments, the center conductor 506 may have another cross-section, such as for example, square, round or some other shape. The center conductor 506 may be fed by a coaxial connector 508 shown by broken lines in FIGS. 5A and 5B or by another suitable arrangement. The center conductor 506 allows the SW waveguide 500 to be narrower than other waveguides without a center conductor because the SW waveguide 500 with the center conductor 506 does not have a low frequency cutoff. As previously discussed, narrower SW waveguides are advantageous for antenna arrays of SW waveguide AISAs because the waveguides can be spaced less than about ½λ apart. Adjacent SW waveguides may also share a common side wall in AISAs.

Figure 6:
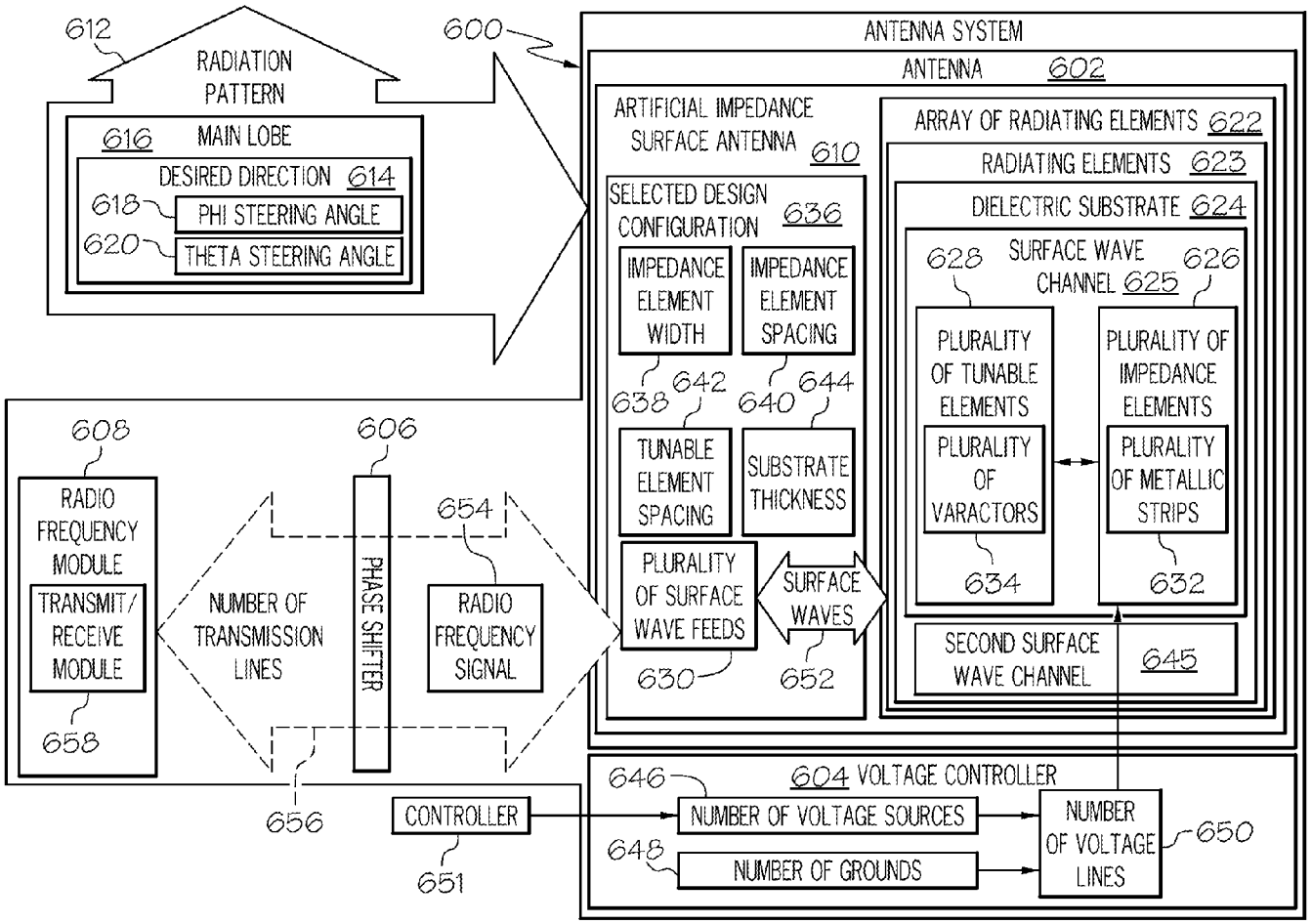
FIG. 6 is a block schematic diagram of an example of an antenna system in accordance with an embodiment of the present disclosure.

FIG. 6 is a block schematic diagram of an example of an antenna system 600 in accordance with an embodiment of the present disclosure. The antenna system 600 may include antenna 602, a voltage controller 604, a phase shifter 606, and a radio frequency module 608. The antenna 602 may be an artificial impedance surface antenna (AISA) 610 in this illustrative example.

The antenna 602 may be configured to transmit and/or a receive radiation pattern 612. Further, the antenna 602 may be configured to electronically control the radiation pattern 612, such as the direction of scan or angle of a main lobe of the radiation pattern 612. When the antenna 602 is used for transmitting, radiation pattern 612 may be the strength of the radio waves transmitted from the antenna 602 as a function of direction. Radiation pattern 612 may be referred to as a transmitting pattern when antenna 602 is used for transmitting. When antenna 602 is used for receiving, radiation pattern 612 may be the sensitivity of antenna 602 to radio waves as a function of direction. Radiation pattern 612 may be referred to as a receiving pattern when the antenna 602 is used for receiving. The transmitting pattern and receiving pattern of antenna 602 may be identical. Consequently, the transmitting pattern and receiving pattern of the antenna 602 may be simply referred to as radiation pattern 612.

Radiation pattern 612 may include main lobe 616 and one or more side lobes. Main lobe 616 may be the lobe at the direction in which antenna 602 is being directed. When antenna 602 is used for transmitting, main lobe 616 is located at the direction in which antenna 602 transmits the strongest radio waves to form a radio frequency beam. When antenna 602 is used for transmitting, main lobe 616 may also be referred to as the primary gain lobe of radiation pattern 612. When antenna 602 is used for receiving, main lobe 616 is located at the direction in which antenna 602 is most sensitive to incoming radio waves.

In this illustrative example, antenna 602 is configured to electronically steer main lobe 616 of radiation pattern 612 in a desired direction 614. The main lobe 616 of radiation pattern 612 may be electronically steered by controlling phi steering angle 618 and theta steering angle 620 at which main lobe 616 is directed. Phi steering angle 618 and theta steering angle 620 are spherical coordinates. When antenna 602 is operating in an X-Y plane, phi steering angle 618 is the angle of main lobe 616 in the X-Y plane relative to the X-axis. Further, theta steering angle 620 is the angle of main lobe 616 relative to a Z-axis that is orthogonal to the X-Y plane.

Antenna 602 may operate in the X-Y plane by having an array of radiating elements 622 that lie in the X-Y plane. As used herein, an "array" of items may include one or more items arranged in rows and/or columns. In this illustrative example, the array of radiating elements 622 may be a single radiating element or a plurality of radiating elements. In one illustrative example, each radiating element in the array of radiating elements 622 may take the form of an artificial impedance surface, surface wave waveguide structure. The SW waveguide structure may be similar to one of those previously described with conductive side walls.

Radiating element 623 may be an example of one radiating element in the array of radiating elements 622. Radiating element 623 may be configured to emit radiation that contributes to radiation pattern 612.

As depicted, radiating element 623 may be implemented using a dielectric substrate 624. Radiating element 623 may include one or more surface wave channels that are formed on the dielectric substrate 624. For example, radiating element 623 may include a surface wave channel 625. Surface wave channel 625 may be configured to constrain the path of surface waves propagated along dielectric substrate 624, and surface wave channel 625 in particular. The surface wave channel 625 may be defined by an impedance sheet, such as the impedance sheet 106 disposed on the dielectric substrate 114 and between the two conductive side walls 102 and 104 in the exemplary SW waveguide 100 described with reference to FIGS. 1A-1C.

In one illustrative example, the array of radiating elements 622 may be positioned substantially parallel to the X-axis and arranged and spaced along the Y-axis. Further, when more than one surface wave channel is formed on a dielectric substrate, these surface wave channels may be formed substantially parallel to the X-axis and arranged and spaced along the Y-axis.

In this illustrative example, impedance elements and tunable elements located on a dielectric substrate may be used to form each surface wave channel of a radiating element in the array of radiating elements 622. For example, surface wave channel 625 may be comprised of a plurality of impedance elements 626 and a plurality of tunable elements 628 located on the surface of the dielectric substrate 624 similar to that previously described with reference to FIG. 1C. Together, the plurality of impedance elements 626, plurality of tunable elements 628, and dielectric substrate 624 form an artificial impedance surface from which radiation or electromagnetic signals may be transmitted or likewise received by the impedance sheet or SW channel 625.

An impedance element of the plurality of impedance elements 626 may be implemented in a number of different ways. In one illustrative example, an impedance element may be implemented as a resonating element. In one illustrative example, an impedance element may be implemented as an element comprised of a conductive material. The conductive material may be, for example, without limitation, a metallic material. Depending on the implementation, an impedance element may be implemented as a metallic strip, a patch of conductive paint, a metallic mesh material, a metallic film, a deposit of a metallic substrate, or some other type of conductive element. In some cases, an impedance element may be implemented as a resonant structure such as, for example, a split-ring resonator (SRR), an electrically-coupled resonator (ECR), a structure comprised of one or more metamaterials, or some other type of structure or element.

Each one of plurality of tunable elements 628 may be an element that can be controlled, or tuned, to change an angle of the one or more surface waves being propagated along radiating element 623. In this illustrative example, each of the plurality of tunable elements 628 may be an element having a capacitance that can be varied based on the voltage applied to the tunable element.

In one illustrative example, a plurality of impedance elements 626 may take the form of a plurality of metallic strips 632 and a plurality of tunable elements 628 may take the form of a plurality of varactors 634. Each of plurality of varactors 634 may be a semiconductor element diode that has a capacitance dependent on the voltage applied to the semiconductor element diode.

In one illustrative example, the plurality of metallic strips 632 may be arranged in a row that extends along the X-axis. For example, the plurality of metallic strips 132 may be periodically distributed on the dielectric substrate 624 along the X-axis. The plurality of varactors 634 may be electrically connected to the plurality of metallic strips 632 on the surface of dielectric substrate 624. In particular, at least one varactor of the plurality of varactors 634 may be positioned between each adjacent pair of metallic strips of the plurality of metallic strips 632. Further, the plurality of varactors 634 may be aligned such that all of the varactor connections on each metallic strip have the same polarity.

The dielectric substrate 624, plurality of impedance elements 626, and plurality of tunable elements 628 may be configured with respect to a selected design configuration 636 for the surface wave channel 625, and radiating element 623 in particular. Depending on the implementation, each radiating element in the array of radiating elements 622 may have a same or different selected design configuration.

As depicted, selected design configuration 636 may include a number of design parameters such as, but not limited to, impedance element width 638, impedance element spacing 640, tunable element spacing 642, and substrate thickness 644. Impedance element width 638 may be the width of an impedance element in the plurality of impedance elements 626. Impedance element width 638 may be selected to be the same or different for each of plurality of impedance elements 626, depending on the implementation.

Impedance element spacing 640 may be the spacing of the plurality of impedance elements 626 with respect to the X-axis. Tunable element spacing 642 may be the spacing of the plurality of tunable elements 628 with respect to the X-axis. Further, substrate thickness 644 may be the thickness of the dielectric substrate 624 on which a particular waveguide is implemented.

The values for the different parameters in the selected design configuration 636 may be selected based on, for example, without limitation, the radiation frequency at which antenna 602 is configured to operate. Other considerations include, for example, the desired impedance modulations for antenna 602.

Voltages may be applied to the plurality of tunable elements 628 by applying voltages to the plurality of impedance elements 626 because the plurality of impedance elements 626 may be electrically connected to the plurality of tunable elements 628. In particular, the voltages applied to the plurality of impedance elements 626, and thereby the plurality of tunable elements 628, may change the capacitance of the plurality of tunable elements 628. Changing the capacitance of the plurality of tunable elements 628 may, in turn, change the surface impedance of the antenna 602. Changing the surface impedance of the antenna 602 changes the radiation pattern 612 produced.

In other words, by controlling the voltages applied to the plurality of impedance elements 626, the capacitances of the plurality of tunable elements 628 may be varied. Varying the capacitances of the plurality of tunable elements 628 may vary, or modulate, the capacitive coupling and impedance between the plurality of impedance elements 626. Varying, or modulating, the capacitive coupling and impedance between the plurality of impedance elements 626 may change the theta steering angle 620 of the antenna 602.

The voltages may be applied to the plurality of impedance elements 626 using voltage controller 604. Voltage controller 604 may include a number of voltage sources 646, number of grounds 648, number of voltage lines 650, and/or some other type of component. In some cases, voltage controller 604 may be referred to as a voltage control network.

A voltage source in the number of voltage sources 646 may take the form of, for example, without limitation, a digital to analog converter (DAC), a variable voltage source, or some other type of voltage source. The grounds 648 may be used to ground at least a portion of the plurality of impedance elements 626. The voltage lines 650 may be used to transmit voltage from the respective voltage sources 646 and/or grounds 648 to the plurality of impedance elements 626.

In one illustrative example, each of the plurality of impedance elements 626 may receive voltage from one of the number of voltage sources 646. In another illustrative example, a portion of the plurality of impedance elements 626 may receive voltage from the number of voltage sources 646 through a corresponding portion of the number of voltage lines 650, while another portion of the plurality of impedance elements 626 may be electrically connected to respective ones of the number of grounds 648 through a corresponding portion of the number of voltage lines 650.

In some cases, the controller 651 may be used to control the number of voltage sources 646. Controller 651 may be considered part of or separate from antenna system 600, depending on the implementation. Controller 651 may be implemented using a microprocessor, an integrated circuit, a computer, a central processing unit, a plurality of computers in communication with each other, or some other type of computer or processor.

Surface waves 652 propagated along the array of radiating elements 622 may be coupled to a number of transmission lines 656 by a plurality of surface wave feeds 630 located on the dielectric substrate 624. A surface wave feed of the plurality of surface wave feeds 630 may be any device that is capable of converting a surface wave into a radio frequency signal and/or a radio frequency signal into a surface wave. In one illustrative example, a surface wave feed of the plurality of surface wave feeds 630 is located at the end of each waveguide in the array of radiating elements 622 on dielectric substrate 624. Similar to that previously described, the surface wave feeds 630 may be a waveguide feed section similar to waveguide feed sections 202 and 302 in FIGS. 2 and 3A respectively.

For example, when antenna 602 is in a receiving mode, the one or more surface waves propagating along radiating element 623 may be received at a corresponding surface wave feed of the plurality of surface wave feeds 630 and converted into a corresponding radio frequency signal 654. Radio frequency signal 654 may be sent to the radio frequency module 608 over one or more transmission lines 656. Radio frequency module 608 may then function as a receiver and process radio frequency signal 654 accordingly.

Depending on the implementation, radio frequency module 608 may function as a transmitter, a receiver, or a combination of the two. In some illustrative examples, radio frequency module 608 may be referred to as transmit/receive module 658 or transceiver.

In some cases, radio frequency signal 654 may pass through the phase shifter 606 prior to being sent to radio frequency module 608. Phase shifter 606 may include any number of phase shifters, power dividers, transmission lines, and/or other components configured to shift the phase of radio frequency signal 654. In some cases, phase shifter 606 may be referred to as a phase-shifting network.

When antenna 602 is in a transmitting mode, radio frequency signal 654 may be sent from radio frequency module 608 to antenna 602 over the transmission lines 156. In particular, radio frequency signal 654 may be received at one of the plurality of surface wave feeds 630 and converted into one or more surface waves that are then propagated along a corresponding waveguide in the array of radiating elements 622.

In this illustrative example, the relative phase difference between the plurality of surface wave feeds 630 may be changed to change a phi steering angle 618 of the radiation pattern 612 that is transmitted or received. Thus, by controlling the relative phase difference between the plurality of surface wave feeds 630 and controlling the voltages applied to the tunable elements of each waveguide in array of radiating elements 622, the phi steering angle 618 and theta steering angle 620, respectively, may be controlled. In other words, antenna 602 may be electronically steered in two dimensions. The phi steering angle may be defined as controlling the angular direction of a main beam of the radiation pattern of the antenna 602 in a plane corresponding to the plane of the antenna 602 or in an X-Y coordinate plane. The theta steering angle may be defined as controlling the angular direction of the main beam of the radiation pattern in a direction perpendicular to the plane of the antenna 602 or in an X-Z coordinate plane.

Depending on the implementation, radiating element 623 may be configured to emit linearly polarized radiation or circularly polarized radiation. When configured to emit linearly polarized radiation, the plurality of metallic strips used for each surface wave channel on radiating element 623 may be angled in the same direction relative to the X-axis along which the plurality of metallic strips are distributed. Typically, only a single surface wave channel is needed for each radiating element 623.

However, when radiating element 623 is configured for producing circularly polarized radiation, surface wave channel 625 may be a first surface wave channel and a second surface wave channel 645 may also be present in radiating element 623. Surface wave channel 625 and second surface wave channel 645 may be about 90 degrees out of phase from each other. The interaction between the radiation from these two coupled surface wave channels makes it possible to create circularly polarized radiation.

The plurality of impedance elements 626 that form surface wave channel 625 may be a first plurality of impedance elements that radiate with a polarization at an angle to the polarization of the surface wave electric field. A second plurality of impedance elements that form a second surface wave channel 645 may radiate with a polarization at an angle offset about 90 degrees as compared to surface wave channel 625.

For example, each impedance element in the first plurality of impedance elements of surface wave channel 625 may have a tensor impedance with a principal angle that is angled at a first angle relative to an X-axis of radiating element 623. Further, each impedance element in the second plurality of impedance elements of the second surface wave channel 645 may have a tensor impedance that is angled at a second angle relative to the X-axis of the corresponding radiating element. The difference between the first angle and the second angle may be about 90 degrees.

The capacitance between the first plurality of impedance elements may be controlled using plurality of tunable elements 628, which may be a first plurality of tunable elements. The capacitance between the second plurality of impedance elements may be controlled using a second plurality of tunable elements.

As a more specific example, the plurality of metallic strips 632 on surface wave channel 625 may be angled at about positive 45 degrees with respect to the X-axis along which plurality of metallic strips 632 is distributed. However, the plurality of metallic strips used for second surface wave channel 645 may be angled at about negative 45 degrees with respect to the X-axis along which the plurality of metallic strips is distributed. This variation in tilt angle produces radiation of different linear polarizations, that when combined with a 90 degree phase shift, may produce circularly polarized radiation.

The illustration of antenna system 600 in FIG. 1 is not meant to imply physical or architectural limitations to the manner in which an illustrative embodiment may be implemented. Other components in addition to or in place of the ones illustrated may be used. Some components may be optional. Also, the blocks are presented to illustrate some functional components. One or more of these blocks may be combined, divided, or combined and divided into different blocks when implemented in an illustrative embodiment.

For example, in other illustrative examples, phase shifter 606 may not be included in antenna system 600. Instead, the transmission lines 656 may be used to couple the plurality of surface wave feeds 630 to a number of power dividers and/or other types of components, and these different components to radio frequency module 608. In some examples, the transmission lines 656 may directly couple the plurality of surface wave feeds 630 to the radio frequency module 608.

In some illustrative examples, a tunable element of the plurality of tunable elements 628 may be implemented as a pocket of variable material embedded in dielectric substrate 124. As used herein, a "variable material" may be any material having a permittivity that may be varied. The permittivity of the variable material may be varied to change, for example, the capacitance between two impedance elements between which the variable material is located. The variable material may be a voltage-variable material or any electrically variable material, such as, for example, without limitation, a liquid crystal material or barium strontium titanate (BST).

In other illustrative examples, a tunable element of the plurality of tunable elements 628 may be part of a corresponding impedance element of the plurality of impedance elements 626. For example, a resonant structure having a tunable element may be used. The resonant structure may be, for example, without limitation, a split-ring resonator, an electrically-coupled resonator, or some other type of resonant structure.

Figure 7:
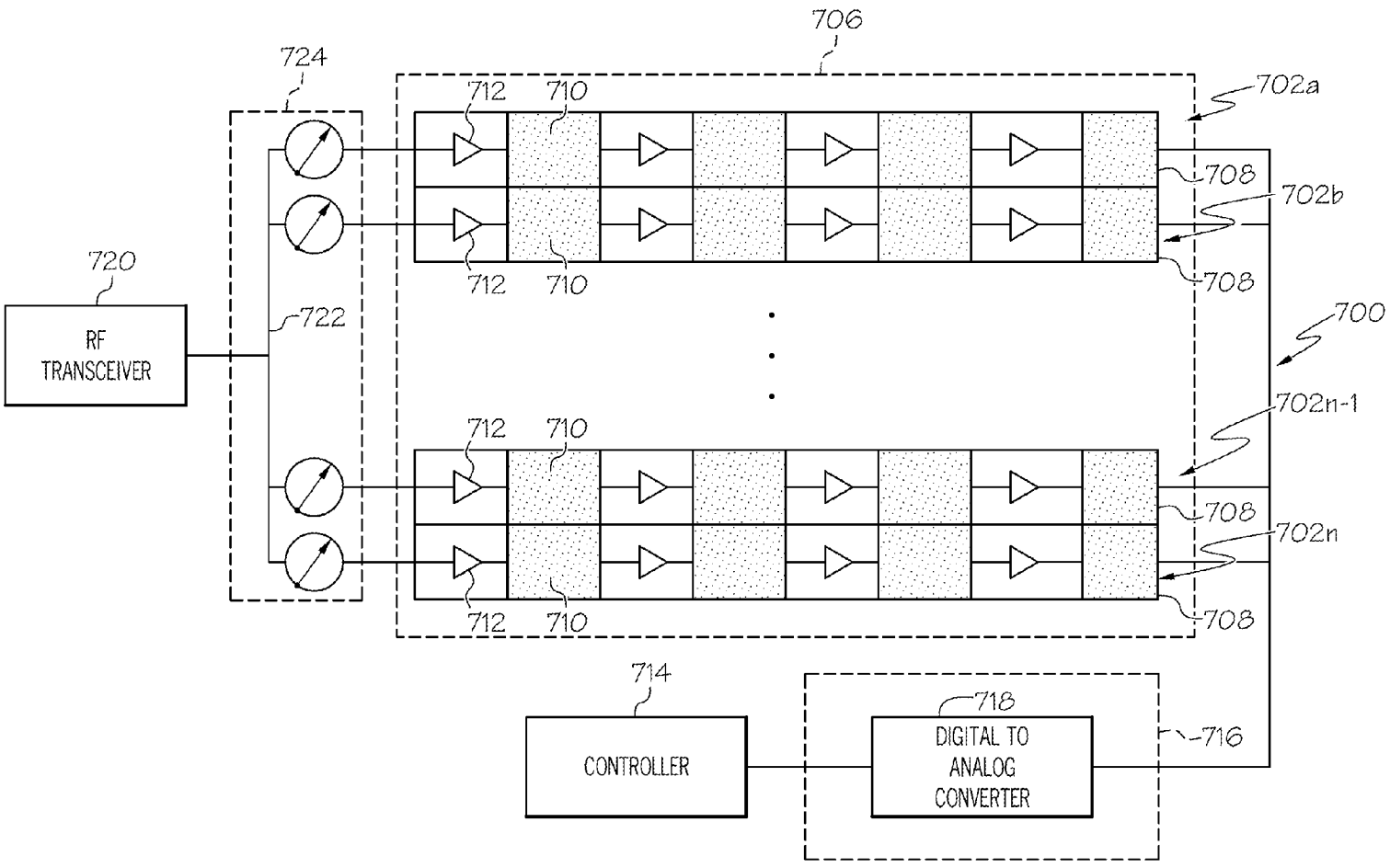
FIG. 7 is a schematic diagram of an example of an antenna system including SW waveguides with conductive side walls in accordance with an embodiment of the present disclosure.

FIG. 7 is a schematic diagram of an example of an antenna system 700 including an array of SW waveguides 702*a*-702*n* with conductive side walls 704 in accordance with an embodiment of the present disclosure. The antenna system 700 may be used for the antenna system 600 of FIG. 6. The array of SW waveguides 702*a*-702*n* may form an AISA 706. The SW waveguides 702*a*-702*n* may be similar to any of the SW waveguides with conductive side walls described herein or other SW waveguide assembly that include conductive side walls. Accordingly, the SW waveguides 702*a*-702*n* may be similar to the SW waveguide 100 described with reference to FIGS. 1A-1C, SW waveguide 200 in FIG. 2, SW waveguide 300 in FIG. 3A, SW waveguide 400 in FIGS. 4A-4B, SW waveguide 500 in FIGS. 5A-5B or other SW waveguide including conductive side walls similar to that described herein. As depicted in FIG. 7, the adjacent SW waveguides 702*a*-702*n* may share a common side wall 704 that permits the adjacent SW waveguides 702*a*-702*n* to be spaced less than about ½λ apart in an array of SW AISAs. In another embodiment, the side walls 704 of adjacent SW waveguides 702*a*-704*n* may abut one another rather than share a common side wall.

In the exemplary embodiment illustrated in FIG. 7, the SW waveguides 702*a*-704*n* may each include a impedance sheet 708 similar to the impedance sheet 106 described with reference to FIG. 1C. However, other impedance sheets similar to those described herein or other configurations may also be used depending upon the particular performance and radiation pattern characteristics desired. In the exemplary embodiment of FIG. 7, the impedance sheet 708 may include a plurality of metallic patches 710. The metallic patches 710 may also be referred to as radiating elements. The metallic patches 710 may be spaced from one another at a uniform distance or may be spaced according to a particular pattern, such as alternating wide and narrow spacing. The metallic patches 710 may also be the same width or may have different widths, such as for example alternating wide and narrow widths. At least one tunable element 712 or variable reactive element may be electrically connected between adjacent metallic patches 710. Examples of the tunable element 712 or variable reactive element may include, but is not necessarily limited to a varactor, a liquid crystal element, a tunable material element comprising barium strontium nitrate or other tunable impedance element capable of modulating or tuning the impedance sheet 708 to provide certain performance characteristics, such as those described herein, for example, steering a main lobe or beam of a radiation pattern of the SW AISA 706. As described in more detail herein the tunable element 712 may be configured to be tuned by a voltage being connected to at least one of the adjacent metallic patches 710 or by electric field or magnetic field being coupled to the tunable element 712.

The antenna system 700 may also include a controller 714 and voltage controller 716 configured to control a voltage or voltages applied to the tunable elements 712 and/or metallic patches 710 for controlling operation and steering of the SW AISA 706. The controller 714 may be similar to the controller 651 described with reference to FIG. 6 and the voltage controller 716 may be similar to voltage controller 604. The voltage controller 716 may include a digital-to-analog converter 718.

The antenna system 700 may also include a radio frequency (RF) transceiver 720 that may be coupled to the SW AISA 706 by a plurality of transmission lines 722 and a phase shifter 724. The RF transceiver 720 may be similar to the RF module 608 of FIG. 6 and the phase shifter 724 may be similar to the phase shifter 606 in FIG. 6. The RF transceiver 720 may transmit and receive electromagnetic or RF signals to and from the SW AISA 706 via the transmission lines 722 and phase shifter 724 similar to that described with respect to the exemplary embodiment of FIG. 6.

Figure 8:
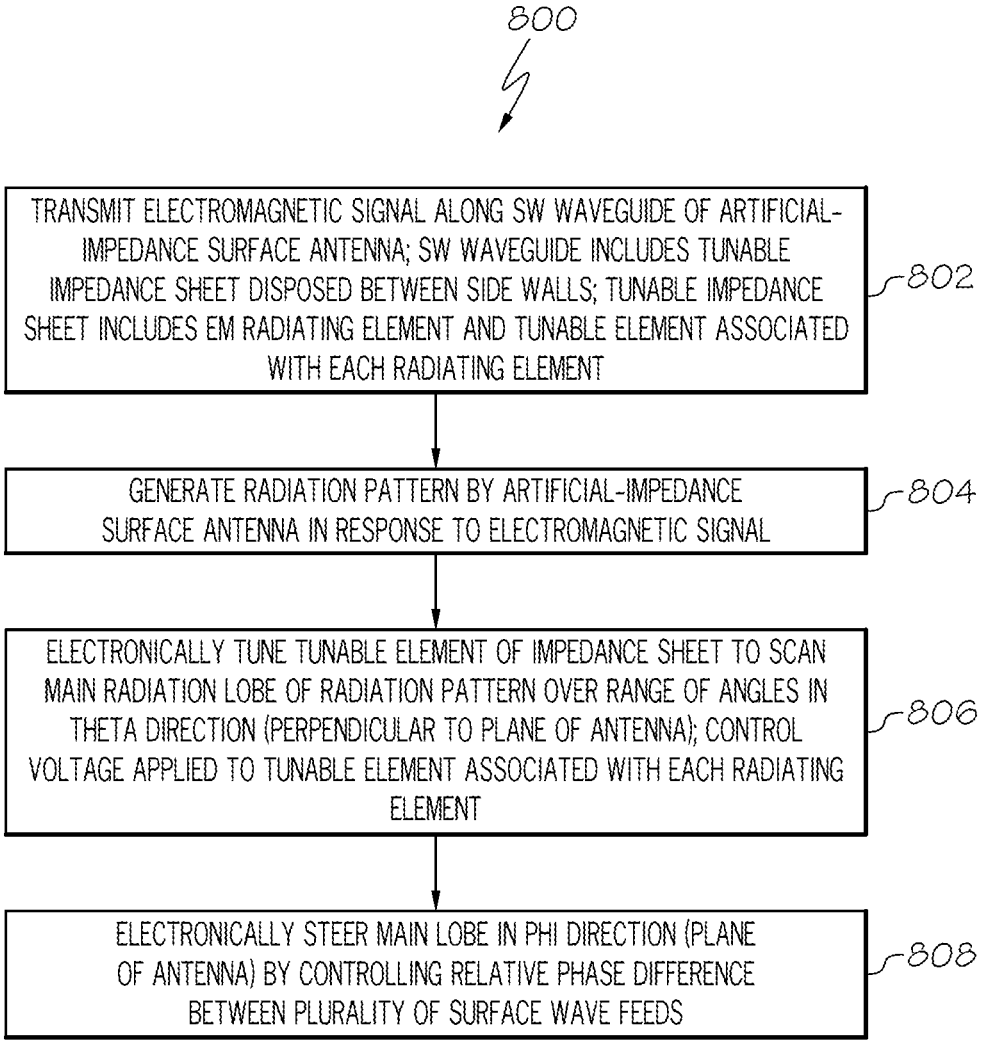
FIG. 8 is an example of a method of operation of an antenna system including surface waveguides with conductive sides in accordance with an embodiment of the present disclosure.

FIG. 8 is an example of a method 800 of operation of an antenna system including SW waveguides with conductive sides in accordance with an embodiment of the present disclosure. The method 800 may be embodied in and performed by the system 600 of FIG. 6 or 700 of FIG. 7. In block 802, an electromagnetic signal may be transmitted along an SW waveguide of an AISA array. The SW waveguide may include a tunable impedance sheet disposed between conductive side walls similar to that described herein. The tunable impedance sheet may include a plurality of electromagnetic radiating elements and tunable elements associated with the radiating elements.

In block 804, a radiation pattern may be generated by the SW AISA in response to the electromagnetic signal.

In block 806, the tunable elements of the impedance sheet may be electronically tuned to scan or steer a main radiation lobe of the radiation pattern over a range of angles in a direction perpendicular to a plane of the antenna (theta direction). A control voltage may be applied to the tunable element associated with each radiating element to scan or steer the antenna.

In block 808, the main lobe may be electronically steered in a plane of the SW AISA (phi direction) by controlling a relative phase difference between a plurality of SW feeds of the SW AISA.

The flowchart and block diagrams in the Figures illustrate the architecture, functionality, and operation of possible implementations of systems, methods, and computer program products according to various embodiments of the present disclosure. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to embodiments of the invention in the form disclosed. Many modifications and variations will be apparent to those of ordinary skill in the art without departing from the scope and spirit of embodiments of the invention. The embodiment was chosen and described in order to best explain the principles of embodiments of the invention and the practical application, and to enable others of ordinary skill in the art to understand embodiments of the invention for various embodiments with various modifications as are suited to the particular use contemplated.

Although specific embodiments have been illustrated and described herein, those of ordinary skill in the art appreciate that any arrangement which is calculated to achieve the same purpose may be substituted for the specific embodiments shown and that embodiments of the invention have other applications in other environments. This application is intended to cover any adaptations or variations of the present invention. The following claims are in no way intended to limit the scope of embodiments of the invention to the specific embodiments described herein.

What is claimed is:

1. A surface-wave waveguide, comprising:

a base conductive ground plane comprising opposite side edges;

a pair of conductive side walls, one conductive side wall extending from each side edge of the base conductive ground plane;

a substrate comprising a dielectric material disposed on the base conductive ground plane and between the conductive side walls; and an impedance sheet disposed on the substrate and between the conductive side walls, wherein edges of the impedance sheet contact an interior of the conductive side walls and ends of the conductive side walls are substantially planar with a surface of the impedance sheet opposite the substrate, the impedance sheet comprising a predetermined impedance characteristic for transmitting an electromagnetic wave.

2. The surface-wave waveguide of claim 1, wherein the dielectric material comprise an air core.

3. The surface-wave waveguide of claim 1, wherein the impedance sheet comprises an array of metallic patches.

4. The surface-wave waveguide of claim 1, wherein the impedance sheet comprises:

a plurality of metallic patches disposed adjacent one another at a predetermined distance; and a tunable impedance element connecting adjacent metallic patches.

5. The surface-wave waveguide of claim 4, wherein the tunable impedance element comprises one of a varactor, a liquid crystal element, and a tunable material element comprising barium strontium nitrate.

6. The surface-wave waveguide of claim 4, wherein the tunable impedance element is configured to be tuned by a voltage being connected to at least one of the adjacent metallic patches or by an electric field or a magnetic field being coupled to the tunable impedance element.

7. The surface-wave waveguide of claim 1, wherein each conductive side wall comprises a multiplicity of vias that are electrically connected between the base conductive ground plane and a conductive strip that electrically connects each adjacent via.

8. The surface-wave waveguide of claim 1, wherein the predetermined impedance characteristic of the impedance sheet comprises a constant impedance characteristic throughout the impedance sheet.

9. The surface-wave waveguide of claim 1, wherein the predetermined impedance characteristic of the impedance sheet comprise a varying impedance characteristic along a length of the impedance sheet.

10. The surface-wave waveguide of claim 1, further comprising a surface-wave coupling structure connected to one end of the surface-wave waveguide, wherein the surface-wave coupling structure is configured to transmit and receive electromagnetic waves to and from the surface-wave waveguide.

11. The surface-wave waveguide of claim 10, wherein the surface-wave coupling structure comprises a waveguide aperture.

12. The surface-wave waveguide of claim 10, wherein the surface-wave coupling structure comprises a waveguide feed section that matingly connects to an end of the surface-wave waveguide and a coaxial connector integrated into a wall of the waveguide feed section that receives a coaxial cable for transmitting and receiving electromagnetic waves to and from the surface-wave waveguide.

13. The surface-wave waveguide of claim 1, further comprising a center conductor disposed within the substrate between the base conductive ground plane and the impedance sheet, the center conductor extending a length of the surface-wave waveguide.

14. The surface-wave waveguide of claim 13, further comprising a coaxial connector electrically coupled to the center conductor, the coaxial connector being configured to receive a coaxial cable for transmitting and receiving electromagnetic waves to and from the surface-wave waveguide.

15. An antenna system, comprising:

a plurality of radiating elements configured to transmit and receive electromagnetic energy, each of the radiating elements comprising a surface-wave waveguide, the surface-wave waveguide comprising:

a base conductive ground plane comprising opposite side edges;

a pair of conductive side walls, one conductive side wall extending from each side edge of the base conductive ground plane;

a substrate comprising a dielectric material disposed on the base conductive ground plane and between the conductive side walls; and an impedance sheet disposed on the substrate and between the conductive side walls, wherein edges of the impedance sheet contact an interior of the conductive side walls and ends of the conductive side walls are substantially planar with a surface of the impedance sheet opposite the substrate, the impedance sheet comprising a predetermined impedance characteristic for transmitting an electromagnetic wave.

16. The antenna system of claim 15, wherein the predetermined impedance characteristic of the impedance sheet comprises an impedance that periodically varies along a length of the impedance sheet.

17. The antenna system of claim 15, further comprising two or more surface-wave waveguides disposed adjacent one another.

18. The antenna system of claim 17, wherein the adjacent surface-wave waveguides share a common conductive side wall.

19. The antenna system of claim 15, wherein the impedance sheet comprises a tunable element that is tunable for scanning a main radiation lobe of a radiation pattern generated by the antenna system over a range of angles in a direction perpendicular to a plane of the antenna system.

20. A method for electronically steering an antenna system, comprising:

transmitting an electromagnetic wave along a surface-wave waveguide, the surface-wave waveguide comprising:

a base conductive ground plane comprising opposite side edges;

a pair of conductive side walls, one conductive side wall extending from each side edge of the base conductive ground plane;

a substrate comprising a dielectric material disposed on the base conductive ground plane and between the conductive side walls; and an impedance sheet disposed on the substrate and between the conductive side walls, wherein edges of the impedance sheet contact an interior of the conductive side walls and ends of the conductive side walls are substantially planar with a surface of the impedance sheet opposite the substrate, the impedance sheet comprising a predetermined impedance characteristic for transmitting an electromagnetic wave, wherein the impedance sheet comprises a tunable element; and tuning the tunable element to scan a main radiation lobe of a radiation pattern generated by the antenna system over a range of angles in a direction perpendicular to a plane of the antenna system.

* * * * *